United States Patent [19]

Stacy

[11] 4,283,805

[45] Aug. 18, 1981

[54] HORSE HOOF PICK

[76] Inventor: Larry C. Stacy, 4851 S. Mission, Fallbrook, Calif. 92028

[21] Appl. No.: 87,003

[22] Filed: Oct. 22, 1979

[51] Int. Cl.[3] ..... B25B 7/22

[52] U.S. Cl. ..... 7/127; 7/133; 7/161

[58] Field of Search ..... 7/125, 127, 133, 161, 7/165; 168/45, 48 R

[56] References Cited

U.S. PATENT DOCUMENTS

| | | | |
|---|---|---|---|
| 145,830 | 12/1873 | Baker et al. | 7/127 |
| 274,570 | 3/1883 | Davis | 168/48 |
| 544,540 | 8/1895 | Jones | 168/45 |
| 1,664,081 | 3/1928 | Means | 7/127 X |
| 2,572,237 | 10/1951 | Andrews | 7/133 X |

FOREIGN PATENT DOCUMENTS

| | | | |
|---|---|---|---|
| 21049 | 6/1910 | United Kingdom | 7/127 |

*Primary Examiner*—James G. Smith

*Attorney, Agent, or Firm*—Wagner & Bachand

[57] ABSTRACT

Horse hoof pick comprising an arm having front and rear end portions and another arm having pivot connection to the first arm intermediate its end portions, the first arm defining at its front end portion a hoof picking head comprising a terminally pointed and rearwardly tapered hook insertable between the frog and horn portions of the horse's hoof, the other arm being angularly adjustable relative to the rear end portion of the first arm to define a handgripping means for the pick variable between a narrow arm spread for prying picking action against accumulated matter, and a wide arm spread for facilitated torque twisting picking action against the matter.

5 Claims, 3 Drawing Figures

HORSE HOOF PICK

BACKGROUND OF THE INVENTION

The invention has to do with a horse hoof pick comprising a first arm and arm having pivot connection to the first arm to define a hand-gripping means for the pick which is variable between a narrow arm spread, for prying picking action against accumulated matter, and a wide arm spread, for facilitated torque twisting picking action against the matter.

More particularly, the present invention pertains to a device to facilitate the removal of accumulated debris from between the frog and horn portions of a horse's hoof more than conventional single-arm devices, and further to provided a pick tool of multiple usefulness for trainers, stablemen and others concerned with horse care.

The hoof of a horse is basically comprised of the horn, sole and frog portions. The horn is perimetrical covering which protects the end of the horse's foot analogously to the nail which protects the end of the human finger and toe. The sole is that portion contained within the perimeter of the horn, and serves to cushion the hoof. The frog portion is the triangular elastic horny pad in the middle of the sole of the horse's hoof; it serves to cushion the hoof as well as to promote the circulation of blood throughout the foot and ultimately throughout the entire body of the horse responsive to successive squeezings as the horse walks or runs.

It is not uncommon for a large mass of accumulated debris, such as dirt, gravel, wood chips, or any combination of these, to become compressed and firmly wedged in the froghorn crevice and/or between the frog and horn portions of the hoof. When this occurs, the horse experiences a great deal of discomfort. Additional and even more significant is the mal-effect this debris has upon the maintenance of blood flow through the animal's circulation system, particularly in the area immediately above the hoof.

The need to prevent accumulation of substantial debris in the hoof is therefore a major concern of the equestrian as well as the owners and trainers of all types of horses.

The effect of this accumulation, unnoticed or uncared for, may cause the horse to suffer irreparable damage, in the hoof itself, and ultimately in its entire body.

PRIOR ART

Tools are known in the prior art for picking and prying accumulated debris from the froghorn crevice and between the horn and frog portions of a horse's hoof. These tools have been handle and pick point combinations not affording substantial variations in torque applied to wedged-in-place debris. These older devices are usually cast in one piece and are formed typically of metal. The arms, incapable of varying their distance from one another, are delimited from the advantages gained by a torque twisting picking action against the accumulated debris between the frog and horn portions of a horse's hoof. Furthermore, the absence of the two arms connected in pivotal relation precludes any provision for utilization of a fulcrum to facilitate the insertion of the pick head and picking action.

SUMMARY OF THE INVENTION

It is, therefore, a major object of this invention to provide a means to pick and pry the accumulated matter effectively and painlessly from the frog portion of the hoof by the use of a hoof pick, which has two arms connected in pivoting relation to permit distance variation between the arms to facilitate variable torque twisting action against the matter to relieve the animal of the discomfort caused by the accumulation of debris and to eliminate the cause of the insufficient blood circulation immediately about the hoof and throughout the horse's body.

A further object of this invention is to provide a fulcrum to facilitate the insertion of the pick head and picking action therewith by positioning an arm against the exterior surface of the horn portion and thereafter increasing the distance between the arms to obtain an increased leverage and to obtain increased torque, which in turn allows for a greater ease of picking with the pick head.

A still further object of the invention is to provide in such a picking tool an anvil, defined by one arm, and a cutting edge, defined by a second arm, which operate in association with the relative pivoting movement of said arms in wire-severing relation, for hay bale wire cutting as a convenience to horsemen, as well as a detent socket mounting for support selectively of a screwdriving head, wrench, bottle cap hook and the like, all to the convenience of horsemen as they go about their daily work chores.

In general, then, the invention provides for a horse hoof pick comprising a first arm having front and rear end portions and another arm pivotably connected to the first arm intermediate its end portions. The first arm defines at its front end portion a hoof picking head comprising a terminally pointed and rearwardly tapered hook insertable into the froghorn crevice and between the frog and horn portions of the horse's hoof. The other arm is angularly adjustable relative to the rear end portion of the first arm to define a hand-gripping means for the pick. The distance between the two arms is variable from a narrow spread for prying picking action against accumulated matter to a wide arm spread for facilitated torque twisting picking action against the matter.

Operatively associated with the pivot connection of the arms is an anvil defined by the first arm and a cutting edge defined by the other arm engageable with the anvil in wire severing relation responsive to relative pivoting movement of said arms.

The first arm portion is further extended beyond its normal hand grippable extent and terminally defines a detent socket mounting structure for supporting e.g. a screwdriving means in spaced relation to the gripping extent, the other arm being pivotable away from the first arm in operating head use facilitating relation, e.g. in screwdriving facilitating relation and spaced against hand injury.

Additionally, a hook-like bottle cap opening means is defined along the first arm portion for arm rear portion leveraged application to a bottle cap, the second arm being pivotable away from the first arm in cap opening facilitating relation. A wrench, leather punch or other type of operating head may be detented in the socket structure as well.

The described device is thus typically employed to facilitate the removal of accumulated debris from between the frog and horn portions of a horse's hoof and includes features in conjunction therewith which provide additional aid and convenience to the horseman.

BRIEF DESCRIPTION OF THE DRAWINGS

The invention will be further described as to an illustrative embodiment in conjunction with the attached drawings, in which.

DESCRIPTION OF THE PREFERRED EMBODIMENT

Figure 1:
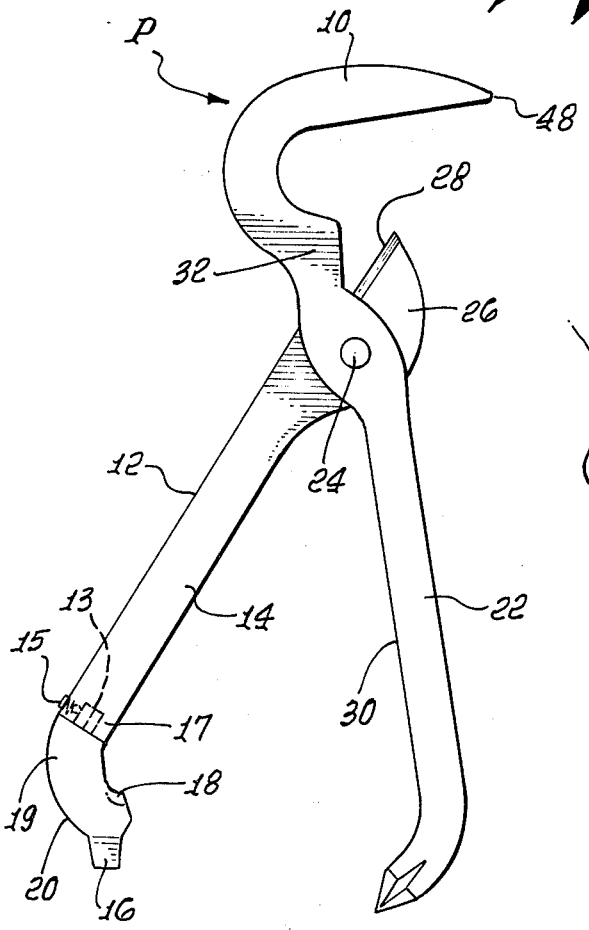
FIG. 1 is a plan view of a horse hoof pick showing the grip portions in a partially spread state.
Figure 2:
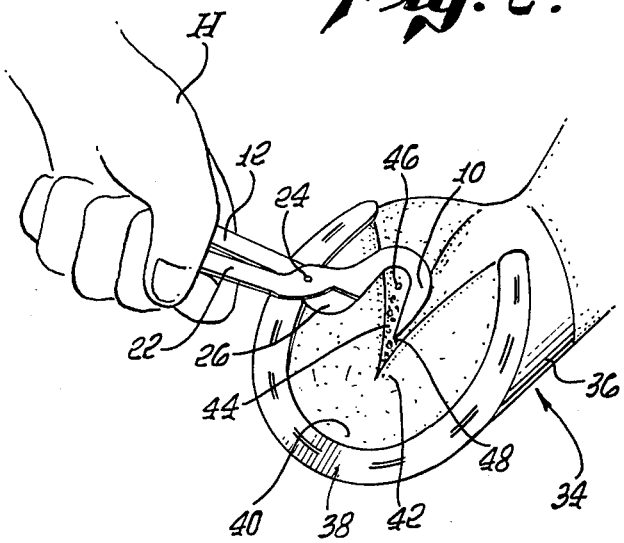
FIG. 2 is a perspective view showing the horse hoof pick in use position between the frog and horn portions of a horse's hoof.

With reference now to the drawings in detail, the present horse hoof pick P is normally constructed of a rigid metal casting, or reinforced rubber or plastic, or a combination of such materials, provided the features of the device are retained, and is depicted in FIG. 1 to comprise arms 12 and 22. The arm 12 referred to as the second arm in the appended claims, includes a hand-gripping portion 14 terminating rearwardly in universal hexagonal socket structure 13 provided with spring loaded detent button 15 for removable mounting by hexagonal stub 17 of operating head 19, shown illustratively to include a screwdriving means 16 and a bottle opening means 18, the latter two being formed in close proximity to one another and defined by a hand guard shoulder 20 integrally formed therewith in a manner so as to prevent hand injury in use of the pick features. Arm 22 is connected to the arm 12 in pivoting relation by pin 24. Arm 22 referred to as the first arm in the appended claims is provided with a terminally pointed, rearwardly tapered semi-arcuately shaped pick head 10 integrally formed anvil 32 and therebeyond hand grip means 30. Cuttingedge 28 integrally formed on portion 26 of arm 12 is carried opposite the anvil 32 and forwardly of the pivot pin 24 to cooperate with the anvil in wire severing relation upon squeezing together of the respective hand gripping portions 14, 30 of arms 12, 22.

Figure 3:
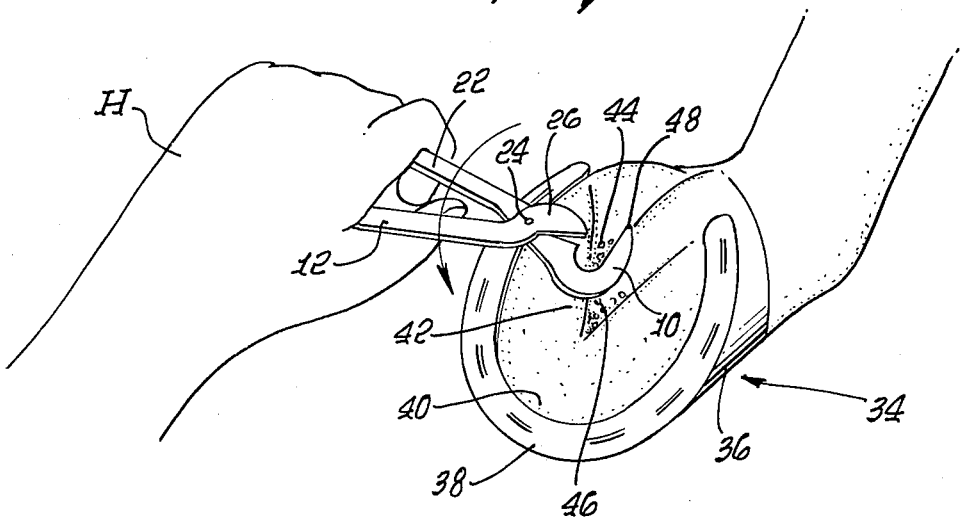
FIG. 3 is a view like FIG. 2, but showing the manipulation of the horse hoof pick between the frog and horn portions of the hoof through the user's application of torque twisting action thereon.

Referring now to FIG. 3, horse hoof 34 is shown comprising horn 36 to which shoe 38 is secured, sole 40, and frog portion 42 with froghorn crevice 44. Accumulated debris 46 is seen embedded in crevice 44. Pick head 10 has point 48 which is inserted into the mass of accumulated matter 46, and with arms 12 and 22 together, the crevice 44 is cleaned. With the arms 12, 22 spread within user's hand H, as in FIG. 3 a greater torque or twisting action may be employed against the matter 46, prying the same free of the froghorn crevice 44 and up for discard therefrom.

Generally, the horseman, in making preparation for his daily work chores around the stable, would first equip himself with the device of the present invention. Attending the health needs of the horse, he might first pick and pry the accumulated matter from between the frog and horn portions of its hooves, then sever the hay bale wire in order to free the hay for feeding the horse. The screwdriving means shown is available to secure any nearby screws. One or more alternate operating heads might be substituted to provide a wrench, a leather punch or other horseman-useful instrument, each being detented in place like the operating head shown. Finally, after several hours of arduous labor, he may choose to rest awhile and partake of liquid refreshment, whereby the convenience of the integral bottle cap opener of the device will be made manifest.

I claim:

1. Horse hoof pick comprising a first arm having front and rear portions and a second arm of unequal length to said first arm and having pivot connection to said first arm intermediate its said end portions, said first arm defining at its front end portion a hoof picking head comprising a hook terminally pointed and rearwardly tapered in the plane of said first arm insertable between the frog and horn portions of the horse's hoof, said second arm being angularly adjustable relative to the rear end portion of said first arm to define a hand-gripping means for said pick variable between a narrow first and second arm spread for prying picking action against accumulated matter, and a wide arm spread for facilitated torque twisting picking action against said matter in first arm plane rotating relation.

2. Horse hoof pick according to claim 1 including also operatively associated with the pivot connection of said first and second arms an anvil defined by said first arm, and a cutting edge defined by said second arm engageable with said anvil in wire-severing relation responsive to relative pivoting movement of said arms.

3. Horse hoof pick according to claim 1, in which said second arm is further extended beyond its normal hand grippable extent and terminally defines a mounting structure for supporting an operating head in spaced relation to said gripping extent, said second arm being pivotable away from said first arm in head operation facilitating relation and spaced against hand injury.

4. Horse hoof pick according to claim 1, including also a bottle cap opening means defined along said second arm for leveraged application to a bottle cap, said second arm being pivotable away from said first arm in cap opening facilitating relation.

5. Horse hoof pick comprising a first arm having front and rear portions and a second arm of unequal length to the first arm and having pivot connection to said first arm intermediate its said end portions, said first arm defining at its front end portion a hoof picking head comprising a hook terminally pointed and rearwardly tapered in the plane of said first arm insertable between the frog and horn portions of the horse's hoof, said second arm being angularly adjustable relative to the rear end portion of the first arm to define a handgripping means for said pick variable between a narrow first and second arm spread for prying picking action against accumulated matter, said pick including also operatively associated with the pivot connection of said first and second arms an anvil defined by said first arm, and a cutting edge defined by said second arm engageable with said anvil in wire-severing relation responsive to relative pivoting movement of said arms, said second arm being further extended beyond its normal grippable extent and terminally defining a detent socket mounting structure for supporting an operating head, in spaced relation to said gripping extent, said second arm being pivotable away from said first arm in operating head operation facilitating relation against hand injury, said pick including also a bottle cap opening means defined along said second arm for leveraged application to a bottle cap, said second arm being pivotable away from said first arm in cap opening facilitating relation.

* * * * *